United States Patent [19]

Dubois et al.

[11] 3,940,011

[45] Feb. 24, 1976

[54] ALL PLASTIC DRUM

[75] Inventors: Robert A. Dubois, Marion, Ohio; William H. Gushard, Staten Island, N.Y.

[73] Assignee: Greif Bros. Corporation, Delaware, Ohio

[22] Filed: Mar. 26, 1975

[21] Appl. No.: 562,124

[52] U.S. Cl. ..... 220/66; 220/72; 220/5 R; 220/DIG. 1

[51] Int. Cl.[2] ..... B65D 7/42

[58] Field of Search ..... 220/72, 66, 69, 70, 83, 220/94 R, 94 A, 5 R, DIG. 1, DIG. 13; D9/170

[56] References Cited

UNITED STATES PATENTS 3,889,839 6/1975 Simon et al. ..... 220/72

FOREIGN PATENTS OR APPLICATIONS 1,207,017 9/1970 United Kingdom

*Primary Examiner*—William Price
*Assistant Examiner*—Steven M. Pollard
*Attorney, Agent, or Firm*—Kane, Dalsimer, Kane, Sullivan and Kurucz

[57] ABSTRACT

An all plastic drum is provided comprising an elongated hollow body member having a circular top end, a circular bottom end, a plurality of flat sides extending between said top and bottom ends, and surfaces blending said flat sides and said top and bottom ends. A bottom end closure extends across the drum bottom end and a top closure extends across the drum top end. The top closure includes at least one recess extending diametrically across the drum. The recess defines a channel which passes beneath a bridge-like structure formed integral with the top closure and spanning the channel.

14 Claims, 2 Drawing Figures

ALL PLASTIC DRUM

BACKGROUND OF THE INVENTION

The present invention relates to drums and in particular to an all plastic industrial drum.

Liquids and semi liquids are commonly transported and stored in drum-like containers. In recent years, the trend has been to form such containers of an outer shell of laminated layers of fibrous material and to provide the shell with an inner plastic liner. More recently, all plastic drums have been introduced. In the main, such all plastic drums, however, have generally been constructed as more or less replicas of conventional non-plastic drums. The conventional cylindrical drum configuration has many advantages and disadvantages. The principal advantage is that the drum may be rolled on its chimes to facilitate movement. This is a very important consideration when it is realized that such drums often have capacities as large as 55 gallons and thus are extremely heavy. The principal disadvantages of such drums are that they cannot be stacked on their sides directly above one another for storage or for discharge of the contents utilizing a spigot. Instead, side stacking requires that the drums be placed in a pyramid shaped configuration. For individual discharge, a frame is required to support the drum on its side.

Another problem of the conventional drum is that its cylindrical body does not lend to orientation of the container when placed in a shipping vehicle such as a trailer truck, van body railroad car, etc. Thus, as often as not, a label positioned on the drum may be blocked or hidden from view when the drum is set in an upright position.

Another problem of existing plastic drums or steel drums is that when they are moved from location to location, a fork lift truck is usually needed. With the conventional cylindrical drum, a clamp or pallet is required to enable the fork lift to get under the drum without damaging the drum.

In view of the above, it is the principal object of the present invention to provide an improved all plastic drum which overcomes each of the aforementioned shortcomings of the conventional, cylindrical drum while maintaining most of the advantages.

SUMMARY OF THE INVENTION

The above and other beneficial objects and advantages are attained in accordance with the present invention by providing an all plastic drum comprising an elongated hollow body member having a circular top end, a circular bottom end, a plurality of flat sides extending between said top and bottom ends, and surfaces blending said flat sides and said top and bottom ends. A bottom end closure extends across the drum bottom end and a top closure extends across the drum top end. The top closure includes at least one recess extending diametrically across the drum. The recess defines a channel which passes beneath a bridge-like structure formed integral with the top closure and spanning the recess. The recess is sufficiently wide to receive a lift truck fork to permit lifting and moving of the drum.

BRIEF DESCRIPTION OF THE DRAWINGS

Reference is now made to the accompanying drawings wherein.

DETAILED DESCRIPTION OF THE PREFERRED EMBODIMENT

Figure 1:
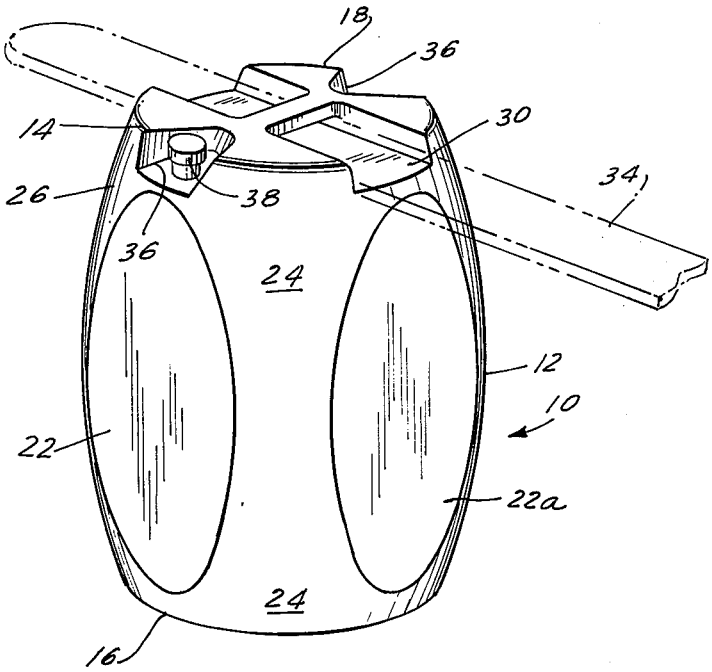
FIG. 1 is a perspective view of an improved drum in accordance with the present invention depicting the drum sides and top; and, FIG. 2 is a perspective view similar to FIG. 1 depicting the drum sides and bottom.

Reference is now made to the drawings wherein a preferred embodiment of the present invention is illustrated in the several views. The present drum 10 comprises a body member 12 having a top end 14 and bottom end 16. A top closure 18 extends across the drum top end and a bottom closure 20 extends across the drum bottom end. The body member and closures are each formed of a fusible plastic material such as polyethylene, polypropylene or the like and most conveniently the drum may be formed by a blow molding process.

In accordance with the present invention, body member 12 is provided with four flat sides 22 disposed at 90° with respect to each other about the body member. The flat sides 22 are generally oval in plan view and rounded surfaces 24 blend adjacent flat sides into each other and surfaces 26 blend the flat surfaces with the top and bottom ends. That is, the connection between the flat surfaces are curved in two planes as shown.

Figure 2:
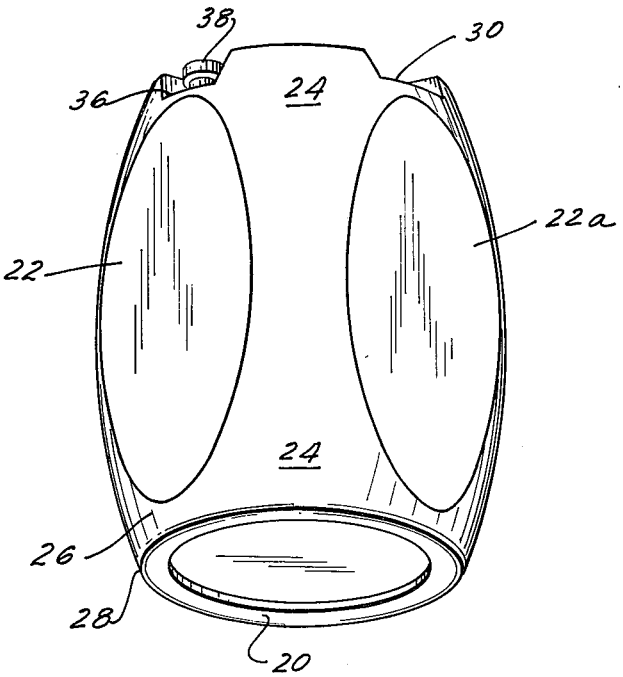

Referring to FIG. 2, it should be noted that the bottom closure 20 is recessed below bottom end 16 of the body member. It should also be noted that the interface 18 of the bottom closure and sidewalls describes a circle thereby permitting the drum to readily be rolled from one position to another when empty or even partially filled in the same manner that conventional drums are rolled. This is an important feature of the present drum.

Referring to FIG. 1, it can be seen that a recess 30 extends diametrically across the drum top closure from one flat side to the opposite side. A bridge-like structure 32 formed integral with the top closure extends transversely spanning across the channel defined by the recess. The recess is sufficiently wide to accommodate the fork 34 (shown in phantom) of a lift truck. In this connection, the recess is also sufficiently deep to permit the fork to pass beneath the bridge-like structure 32 as shown. That is, the bridge structure is spaced above the recess a sufficient distance to accommodate the fork. In this manner, a conventional lift truck fork can readily be used to move the container from one location to another by suspending the drum from the fork as shown. By adjusting the forks on the truck to the proper side-by-side spacing, a fork lift driver can easily pick up two of the drums at a time and transport them. A 55 gallon drum of the type described, when filled with liquid, would weigh on the order of 500 pounds. Thus, when the drum is suspended and transported as described above, it is extremely stable. It should be noted that the recess 30 aligns with the centers of a pair of opposite flat surfaces 22 (denoted by numeral 22*a*). By using these surfaces for labels, the container may be properly oriented so that the label is exposed when the containers are stored or transported.

In addition to the recess 30, a pair of downwardly extending cavities 36 are provided in the drum top closure extending radially inwardly from the drum sides. The cavities 36 extend transverse to recess 30 and are generally aligned with the bridge-like structure 32. The cavities contain fitting 38 adapted to receive conventional pouring and venting necks to permit the contents of the drum to be removed. The cavities thus serve to protect the fittings during handling. The fittings extend to a height below the bridge-like structure and thus are protected against being damaged by the truck fork and in the event the drum should be dropped on its top end during handling.

In use, the drum may conveniently be rolled from one position to another about the circular interface 28 between the sides and bottom closure of the drum in the same manner that a conventional drum may be rolled. The drum can be placed on a side 22 to permit spigot removal of the drum contents without fear of the drum rolling. Also, a plurality of drums may be stacked on their sides with a side 22 of one drum resting on the corresponding flat of another drum. This permits more efficient stacking of drums than the pyramid configuration to which conventional drums are limited. Further, the drum may readily be lifted and moved using a conventional fork lift truck by permitting the fork to pass through recess 30 beneath the bridge-like structure 32. Further, the bridge-like structure 32 provides a convenient means for tilting and rotating the drum by hand, particularly when empty.

Thus, in accordance with the above, the aforementioned objects are effectively attained.

Having thus described the invention, what is claimed is:

1. An industrial drum molded of resinous material comprising: an elongated hollow body member, said member having a circular top end, a circular bottom end, four flat sides spaced approximately 90° apart formed integrally with and disposed about said body member extending between said top and bottom ends, rounded surfaces blending adjacent sides with each other, surfaces blending said flat sides and said drum bottom end, the blending surfaces are arcuate with the diameter of the curves of the transverse sections progressing from the ends to the drum center progressively increasing, means closing the bottom end of the drum, means closing the top end of the drum, walls defining a cavity aligned with one of the flat faces extending downwardly from the outer circular periphery of said top end, a neck fitting extending upwardly from said cavity to a height below that of the means closing the top end of the drum, the cavity extending over a minor sector of the circle defined by the periphery of the top end, the cavity walls surrounding said fitting except from a vertically downward direction and a direction laterally toward the aligned flat face, and being accessible laterally from only the direction of the aligned flat face and from a vertically downward direction.

2. The drum in accordance with claim 1 wherein each of said flat sides comprises an oval in plan view.

3. The invention in accordance with claim 1 further comprising a top end closure extending across said body member top end, a bottom end closure extending across said body member bottom end, and said drum body member and closures are integrally formed.

4. The drum in accordance with claim 1 wherein said top end closure includes at least one recess extending radially inwardly and a bridge-like structure extending transverse to and spanning across said recess.

5. The drum in accordance with claim 4, wherein said recess extends completely across said drum from one flat side to its opposite side.

6. The drum in accordance with claim 5 wherein said bridge-like structure is aligned with the flat sides disposed between said one flat side and its opposite side.

7. The drum in accordance with claim 6 wherein said recess is sufficiently wide and said bridge-like structure is spaced sufficiently high above the recess to accommodate a lift truck fork.

8. The drum in accordance with claim 6 wherein the neck fitting extending upwardly from said cavity to a height below that of the bridge-like structure.

9. The drum in accordance with claim 8 wherein said cavity is aligned with said bridge-like structure.

10. An industrial drum molded of resinous material comprising: an elongated hollow body member, said member having a planar top end and a closed bottom end, said top end being closed and including at least one recess extending radially inwardly diametrically across said top end, a bridge-like structure forming a portion of said top end extending transverse to and spanning across said recess to cooperate with a fork lifting device in lifting said drum and serving as a handle for manually manipulating said drum and walls defining at least one cavity extending downwardly from the outer periphery of said top end, a neck fitting extending upwardly from said cavity to a height below that of the bridge-like structure, the cavity extending over a minor sector of the periphery of the top end, the cavity walls sufficiently surrounding said fitting and being substantially aligned with the bridge-like structure and defining means for preventing access to the fitting in a direction parallel to the recess.

11. A drum in accordance with claim 10 wherein, said drum includes an elongated hollow body member, said member having a circular top end, a circular bottom end, a plurality of flat sides extending between said top and bottom ends, and surfaces blending said flat sides and said drum bottom.

12. The invention in accordance with claim 11, wherein the blending surfaces being arcuate with the diameter of the curves of the transverse sections progressing from the ends to the drum center progressively increasing.

13. The drum in accordance with claim 10, wherein said cavity is aligned with said bridge-like structure.

14. A drum in accordance with claim 10, wherein said drum is molded of resinous material.

* * * * *